US006093083A

United States Patent [19]

Lackey

[11] Patent Number: 6,093,083

[45] Date of Patent: Jul. 25, 2000

[54] ROW CARRIER FOR PRECISION LAPPING OF DISK DRIVE HEADS AND FOR HANDLING OF HEADS DURING THE SLIDER FAB OPERATION

[75] Inventor: Lauren D. Lackey, Simi Valley, Calif.

[73] Assignee: Advanced Imaging, Inc., Camarillo, Calif.

[21] Appl. No.: 09/074,479

[22] Filed: May 6, 1998

[51] Int. Cl.[7] ..... B24B 1/00

[52] U.S. Cl. ..... 451/28; 451/11; 29/603.16

[58] Field of Search ..... 29/603.07, 603.12, 29/603.16, 603.17; 451/28, 41, 11

[56] References Cited

U.S. PATENT DOCUMENTS

| | | | |
|---|---|---|---|
| 3,613,228 | 10/1971 | Cook et al. | 29/603.16 |
| 4,333,229 | 6/1982 | Ellenberger | 29/603.16 |
| 4,376,337 | 3/1983 | Kobayasi et al. | 29/603.16 |
| 4,769,899 | 9/1988 | Yasuda et al. | 29/603.16 |
| 5,329,689 | 7/1994 | Azuma et al. | 29/603.07 |
| 5,454,158 | 10/1995 | Fontana et al. | 29/603.07 |
| 5,588,199 | 12/1996 | Krounbi et al. | 29/603.15 |
| 5,607,340 | 3/1997 | Lackey et al. | 29/603.16 |
| 5,620,356 | 4/1997 | Lackey et al. | 451/28 |

*Primary Examiner*—David A. Scherbel
*Assistant Examiner*—Lee Wilson
*Attorney, Agent, or Firm*—George W. Finch

[57] ABSTRACT

A row of disk drive slider blanks with magneto-resistive read sensors are lapped after being mounted on the flat surface of a row carrier used to mount the row assembly on a row bending tool. Residual stresses present in the row due to wafer processing are relieved by removing the kerf areas between the slider blanks prior to lapping to prevent the stresses from causing inaccuracies in the lapping process. The stability of sliders below 30% can be enhanced by using wafers thicker than is required and then slicing the extra material from the row of slider blanks after it has been bonded to the row carrier either before or after the lapping process.

18 Claims, 5 Drawing Sheets

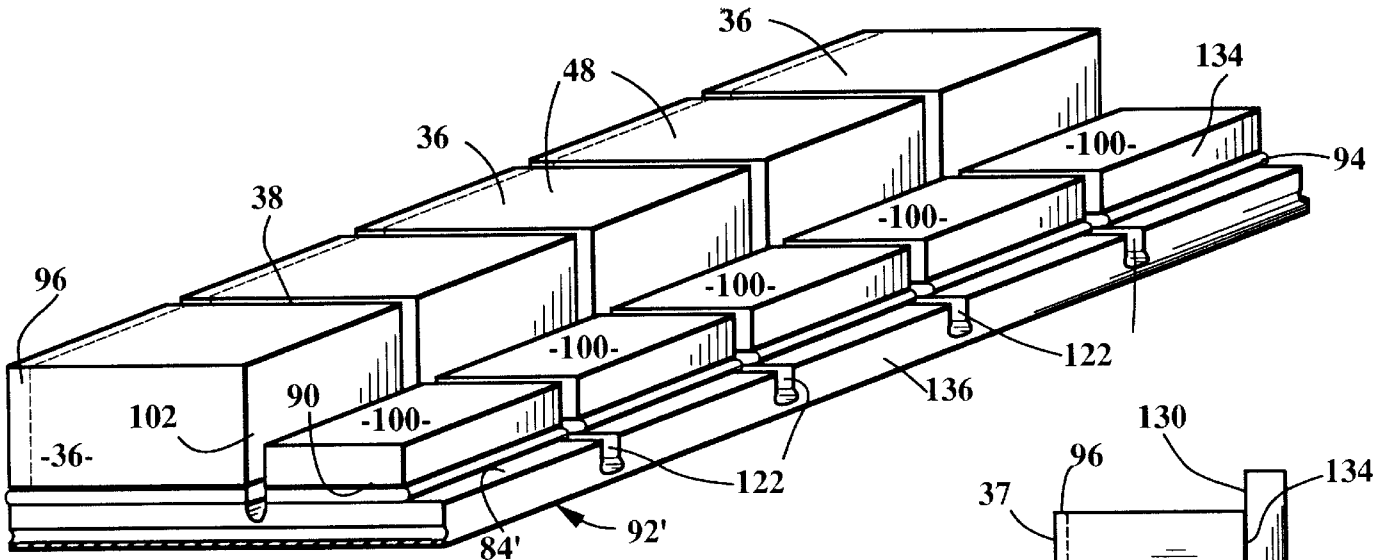
FIG. 12
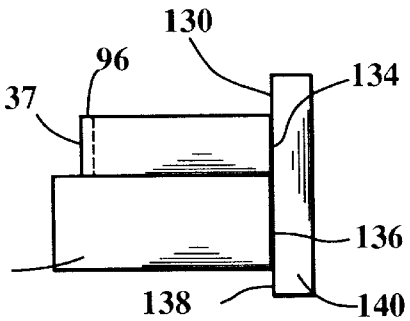
FIG. 16
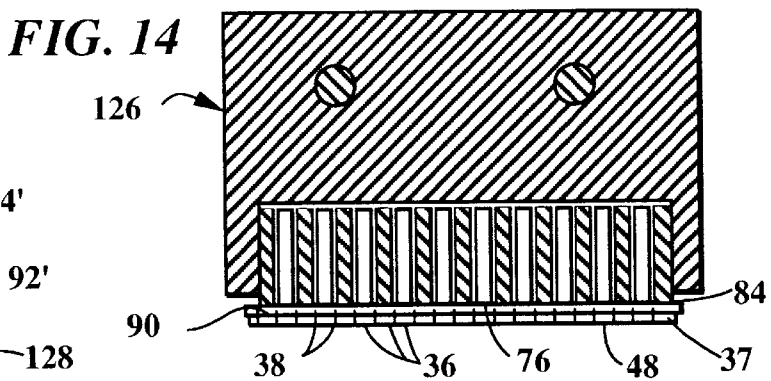
FIG. 14
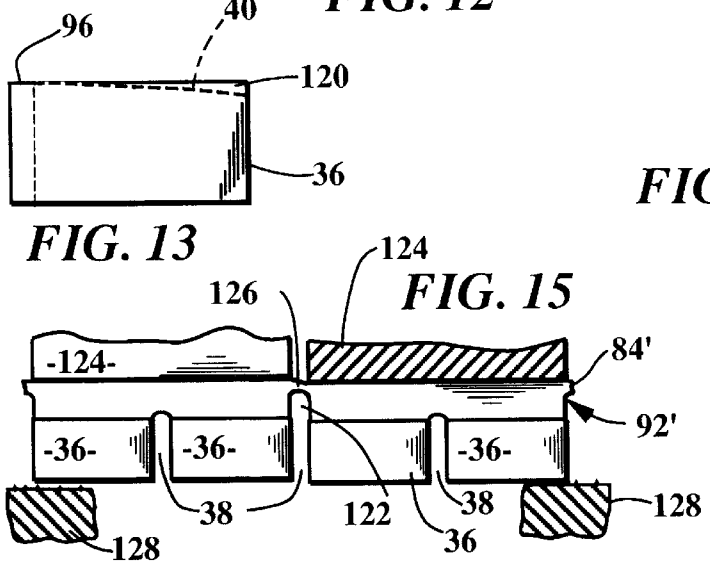
FIG. 15
FIG. 13

ROW CARRIER FOR PRECISION LAPPING OF DISK DRIVE HEADS AND FOR HANDLING OF HEADS DURING THE SLIDER FAB OPERATION

FIELD OF THE INVENTION

The present invention relates to a row carrier that is used for handling the heads during lapping of disk drive heads and is also used for handling the heads throughout the slider fabrication operation. A row of heads is bonded to the row carrier, which is, in turn, bonded to a row tool used on lapping machines. Due to the decrease in the overall dimensions of the advanced technology hard disk heads, there has be a long-standing need for better handing of the heads during the slider fabrication operation since direct handling of the heads can lead to significant yield losses. Heretofore, automated handling has not provided the improvement required for the slider fabrication operation. The row carrier has special importance during the lapping operation since it provides the opportunity to "dice" the heads prior to stripe height lapping. As the requirements for stripe height, crown, twist, PTR (pole tip recession), surface roughness, and cavity depth increase, there has been a long-standing need for improved lapping equipment and processes. The present row carrier permits "single-slider" lapping at the row level by dicing the rows prior to lapping. Lapping at the row level can increase the stresses in the row so that when the row is diced into individual heads, the head twist and the crown of the head change. This slight amount of twist and crown change is unacceptable after dicing for the emerging advanced heads being used in the hard disk drives. These emerging advanced heads will be in full production by 1999.

BACKGROUND OF THE INVENTION

The magnetic devices used to read and write data from the media on a hard disk are called sliders or heads. The previous generation of heads used a single inductive head for both the reading and writing, but such technology could not provide the necessary performance improvements for higher capacity hard disks in high volume production.

Winchester style sliders having thin film, magneto-resistive (MR), giant magneto-resistive (GMR), spin valve, or other types are now being used in magnetic hard disk storage systems to read information magnetically encoded in the magnetic media of the hard disk, with MR elements being the most popular. GMR heads are emerging quickly. A magnetic field extending from magnetic media caused by the spinning of the disk directly modulates the resistivity of the MR element. The change in resistance of the MR element normally is detected by passing a sense current through the MR element and then measuring the changes in voltage across the MR element. The resulting signal is used to recover the digital magnetically encoded information.

Read/write heads are produced by forming the separate read and write elements on a ceramic wafer in a deposition process somewhat similar to that used in the semiconductor industry. The wafer is cut into rows and the slider surfaces are then machined and lapped for proper magnetic and flying height characteristics as described in U.S. Pat. Nos. 5,607,340 and 5,620,356 both by Lackey et al. Tolerances are in the millionths of an inch and are getting tighter as areal densities (the storage bits per unit area) increase. The top surface of the wafer eventually becomes the back surface (trailing end) of the slider, perpendicular to the slider surface (air bearing surface) of the head that forms an air bearing with the media. The electrical resistance of the magneto-resistive material changes when a magnetic field sweeps there through. Normally, a MR head includes a MR stripe having upper and lower sides parallel to the spinning disk media, and conductors that overlay the ends of the stripe at right angles thereto. The conductors define the ends of the stripe and provide the electrical path for the sense current that is used to read the bits of magnetically information. The bits are recorded on the magnetic media by a separate inductive element. The inductive element is formed on the back surface of the head during the wafer process spaced from the MR element.

The change in resistance in a MR element occurs because the magnetic field causes the impedance vector of the material to rotate from a pure resistance, which has the effect of changing the resistance portion of the impedance vector. The effect in the present generation MR elements results in a maximum change in resistance, from 2 to 10%. In the next generations of multi-layer elements, each provide significant improvement, that is the newly available giant MR elements produce a $\Delta R$ of about 10 to 30% and the planned colossus MR elements are expected to produce a $\Delta R$ of over 30%. The more an MR element changes its resistance when exposed to a magnetic field, the smaller the MR sensor element can be, allowing narrower tracks and smaller magnetized areas, so that more data can be stored per unit area of magnetic media.

The signal to noise ratio of a MR element varies with ratio between the resistance, R of the stripe and the change in resistance, $\Delta R$, of the element when subjected to the sweeping magnetic field. The thickness and to a lesser extent, the composition of a stripe are difficult to precisely control during the wafer fabrication process and therefore a precision lapping process that removes material from the flying surface of the slider is used to trim the height of the stripe to obtain maximum signal to noise ratio. If the stripe is too tall, the resistance is to low with respect to $\Delta R$ and the voltage variations due to passing magnetic fields are too low, while if the stripe is too short, the resistance is too high, and the voltage variations due to passing magnetic fields again are too low. In the next generation of heads for drives with even higher areal densities (number of bits per square inch) requiring smaller MR elements, stripe height control to maximize signal output will become ever more critical, requiring lapping to magnetic performance and control on the order of a millionth of an inch. In addition, the stripe height lap and a final crown lap need to be combined since stripe height is reduced by the final crown lap.

MR elements are constructed by laying down thin stripes of MR material using wafer fabrication techniques similar to those developed in the semiconductor industry. The wafer is then sliced so that the MR stripes are positioned adjacent what will become the slider air bearing surface along what will become the trailing or back edge of the slider. Two conductors are formed over each end of the stripes so that the changing resistances due to magnetic fields impinging therein can be measured by a sensing current fed there across.

The most common control approach for lapping uses magneto-resistive electrical lapping guides (MR ELGs) that are formed at intervals along each row of MR elements. Generally MR ELGs are long MR elements with separate connections to the control systems for the lapping machines. In order to find the proper relationship between the stripe height and the measured resistance, it is necessary to calculate the "sheet resistance" of the MR element by finding the sheet resistance of the surrounding MR ELGs. There are many circuit designs for performing this type of calibration of the sheet resistance.

Unfortunately, the resistivity of the MR film varies over each wafer and more particularly over the length of a row of elements on the wafer. Therefore, the resistivity of MR elements distant from a MR ELG and the MR ELG may be different, creating an electrical offset error from head to head and from MR element and the MR ERG. Also, feedback from a MR ELG, which is physically offset from the MR element whose height it is trying to control, creates a physical offset error. This may seem minor, but if the distance between a MR ELG and the MR element whose height its is controlling is 0.008 inches and the desired control is 1 microinch, this is a ratio of 1 to 8,000. Some data scatter is also attributable to imprecise formation of the MR stripes.

One solution for variations in sheet resistivity and stripe variations suggested in the past was to measure the resistance of an MR element as its height is being trimmed during the lapping operation. With prior technology, direct measurement has been only marginally acceptable. Since the MR elements are microscopic, there is often a large error between actual stripe height and measured resistance. There also is a "blurring" of the contact between the ends of the MR element and the conductors. Since the MR element is short, this blurring becomes a significant percentage. Separate MR ELGs are typically 10 to 20 times longer than the MR element, which minimizes this "blurring" error. Also, to sense the resistance of MR elements directly requires electrical connections and disk drive manufacturers typically do not want wire bonding marks that result from the bonded connections nor probe card marks, present on the MR element bond pads, because such can adversely affect the reliability of new wire bonds or pressure connections when pressure contact pads are employed.

Current fabrication techniques cannot maintain the needed control of sheet resistance so the width of the stripe is critical to get the optimal response from the MR element, which is a function of element resistance and $\Delta R$ resistance due to the impingement of a magnetic field. Therefore, a lapping operation of the slider air bearing surface has been used to adjust the width of the MR strip to an accuracy of several millionths of an inch with processes, machines, and devices such as shown and described in U.S. Pat. Nos. 5,607,340 and 5,620,356, both by Lackey et al.

During head production, batch fabrication is employed whereby a plurality of transducers are sliced from a ceramic wafer in a row and bonded onto a row bending tool for stripe height lapping. Row bending tools are commonly constructed from ceramic or steel in a configuration of flexures that allow forces applied to a row bending tool to deform the attached row in up to a fourth order curve in a single plane. During the manufacture of the sliders, this allows a plurality of MR transducers to have their stripe height to be precisely lapped to achieve a desired stripe height at which optimum data signal processing can be realized. The stripe height of all the transducers made during a production run for use with a data storage product must be maintained within a defined limited tolerance.

The process steps performed on the wafer generate residual stresses, which can cause the rows to bend when they are sliced away from the rest of the wafer, a condition known as "row bow". Although the level of stress can be reduced through care in the wafer fabrication process, it can not be eliminated. Also some manufacturers have processes where reduction of residual stress is not stressed as much as others. Although a curved row theoretically can be straightened for lapping by bonding it to a row bending tool, the stresses are not always uniform across a row, resulting in kinking of the row during bending in the lapping operation. The result is a wide variation in stripe heights across the row after the lapping operation. This variation in stripe height affects ultimate process yields as MR elements get smaller. As a result, MR sensors can not be properly lapped with high yields at the very close tolerances needed when sliders below 50% (>2.05 mm length×1.6 mm width×0.43 mm thick), that is 50% of an early initial slider standard of 4.02 mm length×3.2 mm width×0.86 mm thick, are constructed. Also, such sliders present such a small surface opposite the surface to be lapped that they are difficult to mount to a row bending tool and lap to the desired slider surface shape.

Prior attempts to correct for ceramic bar or slider bar distortion are disclosed in U.S. Pat. Nos. 5,117,539 and 5,203,119, 5,607,340, and 5,607,340. However, none are totally satisfactory, when extraordinary care is not used in the wafer processing to minimize residual stresses. Therefore, a long standing need has existed to provide an apparatus and method to relieve residual stresses in a row of sliders and to accurately mount it on a row bending apparatus so that MR sensor stripe height on a plurality of sliders in the row can be accurately controlled during lapping by accurately bending the row or varying the lapping pressure of individual heads.

Also, there has been a long-standing need for handling the individual heads during the slider fabrication operation. The bonding on the row during lapping is just one of a plurality of bonding and debonding operations. As the row and the heads become smaller and more fragile, there is a yield loss during each bonding and debonding operation. After the row is bonded to the row carrier after slicing, the row carrier becomes smaller and more fragile, there is a yield loss during each bonding and debonding operation.

BRIEF DESCRIPTION OF THE INVENTION

When rows of sliders are cut from the wafer, some residual stresses from the manufacturing processes are always present causing curvature from bottom to top, but little side to side curvature because the row is wider than tall. In the present invention, the under surface of a row of MR sensor sliders is bonded to a flat surface (preferably optically flat) of a elongate row carrier having an opposite and parallel surface for bonding to a row bending apparatus. The row carriers may be made from ceramic, steel or other physically stable materials that are compatible with other process steps. Ceramic row carriers are relatively easy to manufacture with precisely formed surfaces and are preferred because the thermal expansion coefficient of ceramic can be matched to the thermal expansion coefficient of the wafer material. However, steel is preferred when movement between adjacent sliders is desired and the brittleness of ceramic prevents such movement. The row carrier is chosen to be as stiff or stiffer than the row, usually by having fore to aft and top to bottom thickness so bonding tends to straighten the row of sliders. However, at the extreme accuracy that slider heads now require, the slight bending of the ceramic carrier caused by the initial stresses induced by the row of sliders and changing stresses as the row of sliders is lapped, can introduce error. Therefore, once the row of sliders is bonded to the carrier, the row may be diced (usually by sawing with a fine saw) to separate all of the sliders. If the row is diced, this further reduces stresses that can develop to undesirably deform the carrier to such an extent that down to 5% sliders can be properly lapped using available technology. If row bending apparatus are to be used, the saw cuts only extend into the carrier far enough to assure that all sliders are separated from each other. When apparatus that applies pressure to individual heads is used, the saw cuts preferably extend almost through the carrier or it is cut almost completely through in advance. By lapping the sliders individually after dicing, the residual stresses are removed much better that if not diced before lapping.

The row carrier becomes a carrier for the row for handling purposes so that individual sliders do not need to be directly handled.

When a row is lapped without dicing, the residual stresses remain in the row. After dicing the sliders can twist, which could cause the slider to be rejected unless another lapping operation is performed. This operation, called a touch or crown lap, while removing the twist and other lapping problems, causes the stripe height (and its magnetic performance) to be degraded to an unacceptable level. Also, when lapping the row (without dicing on the row carrier) the row bending equipment used for dynamic row bending can put stresses into the row during the bending to correct for the row bow.

The fore to aft dimension of a slider row is determined by the thickness of the wafer. Wafers become so thin that stress inducing fabrication steps cause them to bend like a "potato chip" after being debonded from the wafer carriers.

In the present invention, thicker wafers may be used so that the fore to aft dimensions of the sliders are larger than needed. Then, once the row of sliders is bonded to the row carrier, the extra material can be separated from the row of sliders by dicing the row parallel to the surface thereof on which the MR sensors are formed. The extra material remaining on the row carrier can be retained to stabilize the row of sliders during lapping or it can be ground away to allow lapping of just the slider surface. After lapping has established the proper stripe height of the MR sensors in a row, the sliders can be retained on the row carrier for further batch process steps or the sliders can be debonded therefrom for further individual process steps.

Therefore, it is an object of the present invention to reduce the residual stresses in a row of hard disk drive sliders with MR sensors formed thereon, so that accurate lapping of the stripe height of the MR sensors can be accomplished for small sliders, either by row bending or individualized pressure applied to the sliders.

Another object is to allow the batch manufacture of MR sensor containing hard disk drive sliders in sizes less than 30%.

Another object is to provide means for accurately lapping MR sensor sliders and holding the sliders for further process steps.

Another object is to reduce the handling required to fabricate MR sensor sliders, and thereby reduce electrostatic discharge damage thereto.

Another object is to mechanically stabilize MR sensor sliders during lapping operations.

Another object is to provide a convenient handling jig and method for automated inspection and for automated measurement since most of the present automated inspection and automated measurement have complex and expensive handling mechanism for single-slider processing, which is eliminated with the present row carrier.

These and other objects and advantages of the present invention will become apparent to those skilled in the art after considering the following detailed specification, together with the accompanying drawings wherein:

BRIEF DESCRIPTION OF THE DRAWINGS

FIG. 12 is a partial cross-sectional perspective view similar to FIG. 10 of a row carrier and row designed for individualized slider stripe height control;

FIG. 13 is a side elevation view of a slider, showing the curvature that some manufacturers desire;

FIG. 14 is a cross-sectional elevational view through the row carrier of FIG. 12 attached to an apparatus for applying different lapping pressures to each slider;

FIG. 15 is an enlarged cross-sectional elevational view similar to FIG. 14 showing the fingers of the apparatus of FIG. 14 displacing two sliders at a time; and FIG. 16 is a side elevational view showing one method of aligning a row of sliders with a row carrier.

DETAILED DESCRIPTION OF THE SHOWN EMBODIMENTS

Figure 1:
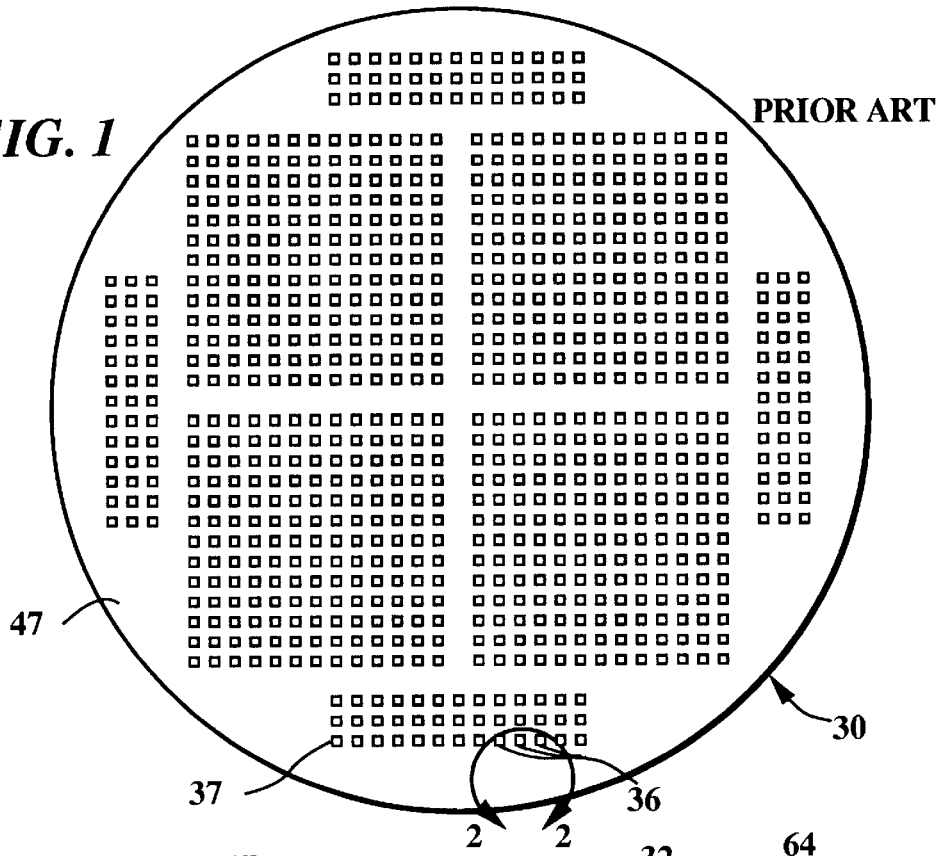
FIG. 1 is a plan view of a prior art wafer used to construct disk drive sliders.

In the Figures that follow, the invention is illustrated, but the scale and form of the components are not always exact. Referring to the drawings more particularly by reference numbers, number 30 in FIG. 1 refers to a ceramic wafer, such as those used in forming magneto-resistive (MR) sensors 32 from MR thin films and electro-magnetic writing heads 34 on disk drive sliders 36, as shown in FIG. 2.

Figure 2:
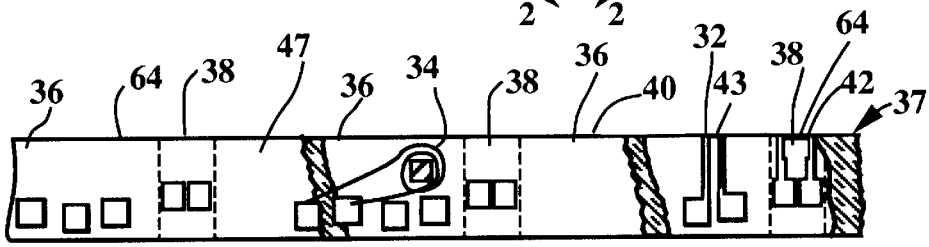
PRIOR ART FIG. 2
FIG. 2 is an enlarged detailed view of a portion of a bar of sliders taken generally from the area 2—2 of FIG. 1.
Figure 3:
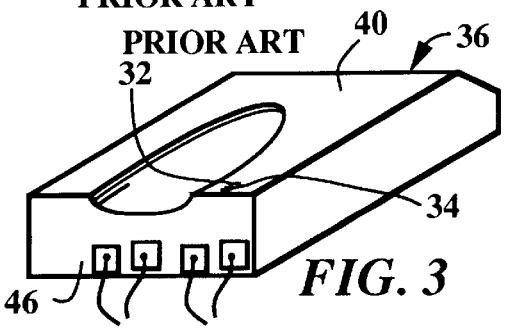
FIG. 3 is an enlarged perspective view of a completed slider.
Figure 4:
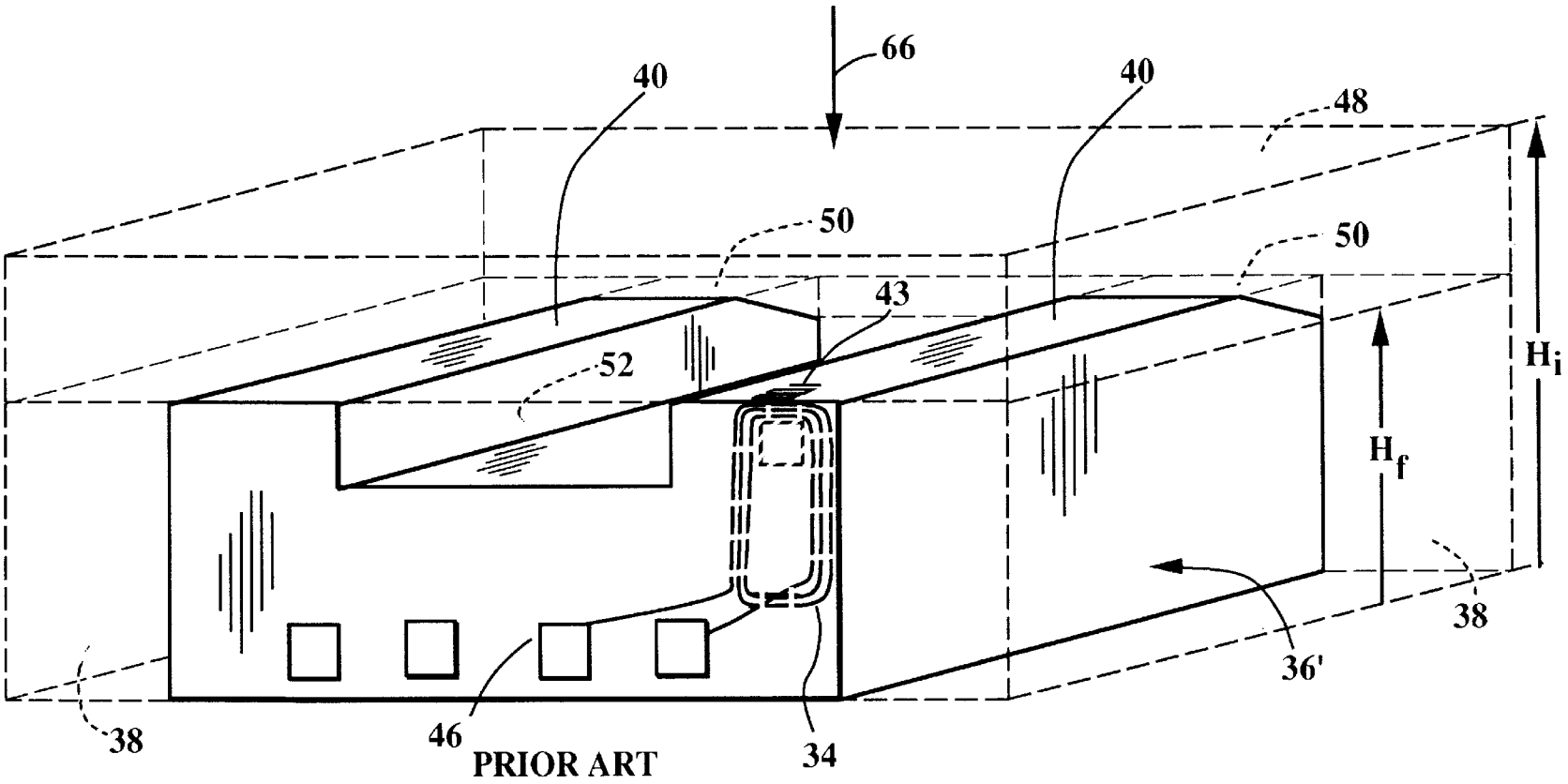
FIG. 4 is an enlarged perspective view of a slightly different slider showing areas of the wafer bar removed during the fabrication process.

FIG. 2 is a portion of a row 37 of sensors 32 and writing heads 34 as they are formed on the wafer 30 and cut therefrom. The row 37 includes a plurality of what will be disk drive sliders 36, as shown in FIGS. 3 and 4, separated by kerf areas 38, which are removed during sawing or dicing of a finished row 37 to separate the sliders 36. The MR sensors 32 cannot be formed and placed with the exactitude required for high performance disk drives. Therefore the flying or slider surface 40 is lapped until the MR sensors 32 have optimum electrical characteristics. Typically, the progress of the lapping process is monitored with electrical lapping guides (ELGS) 42 positioned at spaced intervals along the row 37 in the kerf areas 38. To obtain high accuracy, ELGs 42 are ten to twenty times wider than the MR elements 43. Due to the small size of each MR element 43 and the inability of present processes to maintain a constant sheet resistance across a wafer 30, there may be a large error between actual stripe height and measured resistance. There is also a "blurring" of the contact between the ends of the MR elements 43 and their conductors. Since the MR element 43 is short, this blurring can becomes a significant percentage of the total resistance, which is to be measured. By making the MR ELG 42 ten to twenty times longer than the MR element 43, this blurring error is minimized.

As aforesaid, the resistivity of the MR film forming the elements 43 typically changes over the length of a row 37 on a wafer 30 and therefore, the resistivity of an MR element 43 and a MR ELG 42 spaced at a distance therefrom may be different, creating offset errors from slider 36 to slider 36. Offset errors are also created by imperfections in the photolithographic process used to position the MR sensors 32 and ELGs 42 on the wafer 30. Feedback from a MR ELG 42, which is physically offset and out of alignment with the device it is trying to control creates an offset error. This may seem minor, but if the distance between an ELG 42 and the MR sensor 32 is 0.008 inches and the desired control is 1 microinch, this is a ratio of 1 to 8,000.

FIG. 3 shows the slider surface 40 of the slider 36, which is the surface that is lapped to form the MR sensor 32. Normally MR sensors 32 are formed just under the rear surface 46 of the slider 36 by first laying down the MR sensor 32 and then forming the write head 34 on layers there over. The details of the rear surface 46 shown in FIG. 2 are shown with protective layers 47 both on the back surface 46 cut away.

Figure 5:
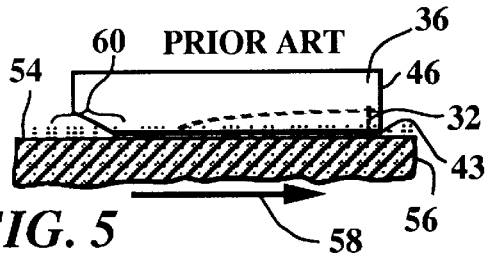
FIG. 5 is an enlarged side elevation view of a slider, aerodynamically flying over the magnetic media of a hard disk also showing the magnetic fields extending from the disk which are read by the slider.

FIG. 4 shows a modified slider 36'. The ceramic material normally removed to form the slider 36' is shown in dotted outline. After a rough lap or grinding operation to remove excess material left at slicing on the row 37, generally the layer 48 is lapped away as the lapping progress is monitored by the ELGs 42 (FIG. 2). Then material at the kerf areas 38, the leading edge wedges 50, and a slot 52 is milled away, such as by ion milling. The slot 52 may be the length of the slider 36' or just a portion thereof as shown in slider 36 of FIG. 3. When properly manufactured, a slider 36 will aerodynamically fly just over the surface 54 of the disk 56 of a disk drive, as shown in FIG. 5. The relative movement of the disk 56 with respect to the head 36 is shown by the arrow 58. The write head 34 magnetizes small areas of the disk 56, which produce a pattern of magnetic fields 60. When the magnetic fields 60 pass through the MR element 43, the electrical resistance thereof is reduced. The reduction in resistance is sensed by passing a sense current through the MR element 43 and monitoring the voltage changes created thereby.

MR elements 43 are thin film devices. Since the manufacturing process for such thin films cannot be precisely controlled, the thickness and the bulk characteristics of the element 43 cannot be precisely controlled at the wafer level. In order to find the proper relationship between the stripe height and the measured resistance, it is necessary to calculate the "sheet resistance" of the MR element 43 by finding the sheet resistance of the adjacent MR ELGs 42. There are many circuits for performing this type of calibration of the sheet resistance known in the prior art.

The relationship between the overall resistance, R, of the MR element 43 and the change in resistance, $\Delta R$, is critical to obtaining a MR sensor 32 with an acceptably high signal-to-noise ratio. Therefore, the process of making MR sensors 32 for disk drive sliders 36 starts with elements 43 having initial heights, Hi, that are too large. A diamond lapping process then is used to lap away the surface 40 of a row 37, while ELGs 42 with MR elements 64 of the same material and thickness as the MR elements 43, are used to electrically monitor the lapping process as the surface 40 is being lapped in the direction of arrow 66 to assure that useful MR sensors 32 are produced each having final heights $H_f$ in an acceptable range. The acceptable range is becoming smaller continuously. The MR element 43 so formed acts as a variable impedance when impinged upon by a magnetic field 60.

Figure 6:
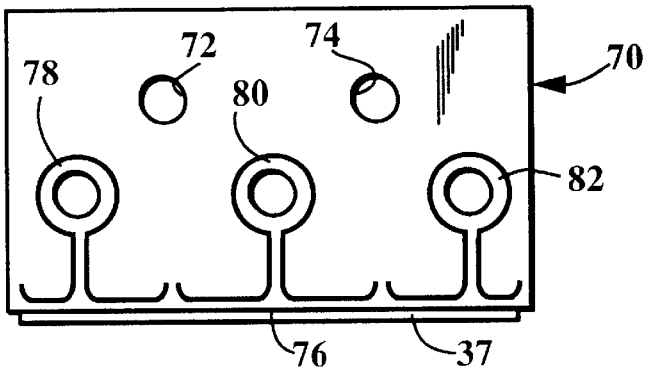
FIG. 6 PRIOR ART
FIG. 6 is a side elevation view of a row of sliders attached to a prior art row bending tool.
Figure 7:
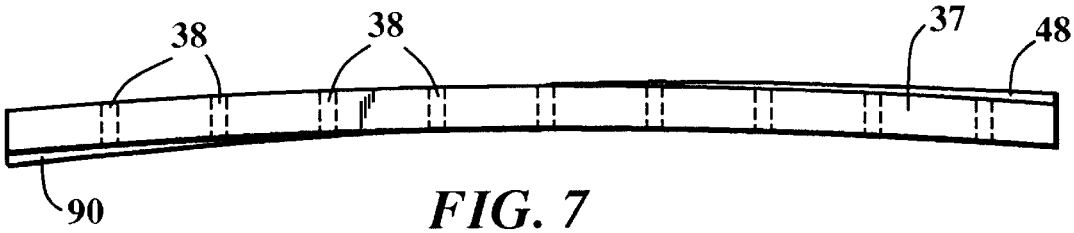
FIG. 7 is an enlarged side elevational view of a row of sliders showing a greatly exaggerated possible curvature that can occur after the row has been sliced from the wafer of FIG. 1.

The prior art processes taught in U.S. Pat. Nos. 5,607,340 and 5,620,356 use two or more ELGs 42 formed on a row 37 of about 20 sliders, which are all lapped at the same time by bonding the slider row 37 on a row bending tool 70, as shown in FIG. 6. The slider row 37, with its MR elements 43 and ELG elements 64, is lapped while the lapping process is monitored by the ELGs 42. The row bending tool 70 is held by two mounting holes 72 and 74 while its face 76 and the row 37 bonded thereto are bent into up to fourth order curves in the vertical plane parallel to the tool 70 by applying forces to bending connections 78, 80, and 82. As the tolerances for the MR elements 43 get tighter, the curvature of the row 37 caused by the process steps at the wafer stage, causes inaccuracies that can not be accommodated by the tool 70.

Figure 8:
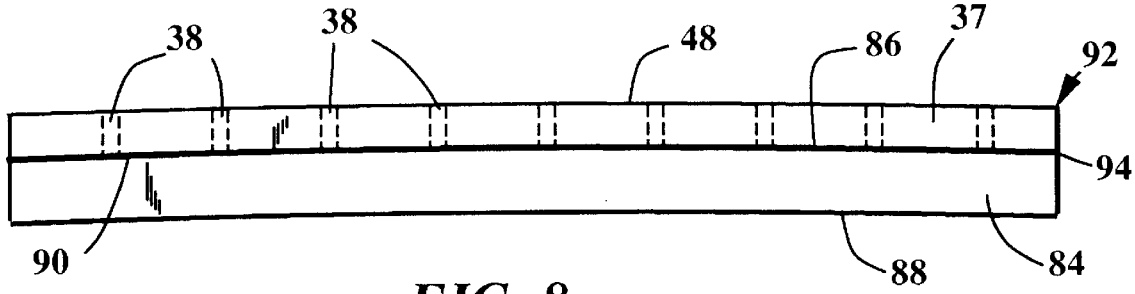
FIG. 8 is an enlarged side elevational view of the row of sliders of FIG. 7 after it has been bonded to a flat surface of a row carrier.
Figure 9:
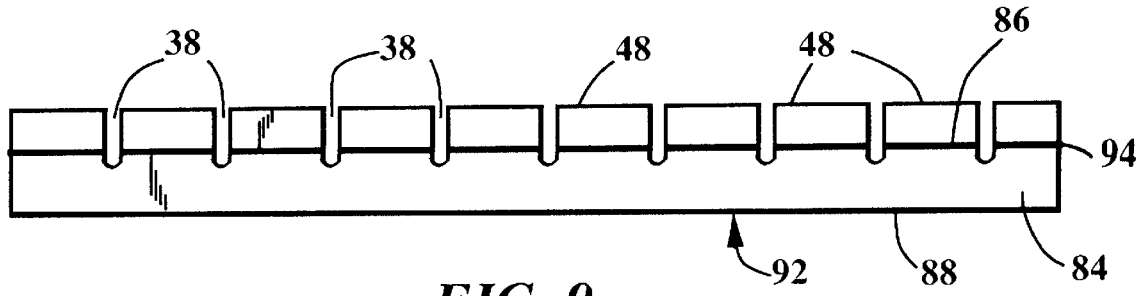
FIG. 9 is an enlarged side elevational view of the row of sliders and row carrier of FIG. 8 after the row of sliders have been diced into individual sliders.

In the present invention, a straight ceramic or steel row carrier 84 with a rectilinear cross-section and preferably an optically flat surface 86 and a parallel surface 88 is constructed. Suitable materials for the row carrier 84 include ceramic, steel, or other materials that have suitable flexibility and thermal expansion characteristics. Generally the material of the row carrier 84 should be relatively stiff and have a temperature expansion coefficient similar to that of the wafer 30 from which the row 37 is constructed. As shown in FIG. 8, the under surface 90 of the row 37 is bonded to the flat surface 86 with the surface 48 to be lapped generally parallel to the surface 86. Although the row carrier 84 is may be physically larger and stiffer than the row 37, when dealing in microinches, bonding a row 37 that is curved because of residual stresses to the row carrier 84 can cause some deflection of the row and row carrier assembly 92. This deflection is shown as causing a smooth curve in FIG. 8, however prior art data scatter indicates that unpredictable kinks are present. Therefore, once the assembly 92 is formed, the kerf areas 38 are diced away. As shown in FIG. 9, the removal of material may extend through the bonding agent 94 and into the row carrier 84. This greatly relieves the residual stresses and allows the assembly 92 to return to a flatness, suitable for lapping sliders 36 down to 5% sliders. To allow such kerf area removal, the ELGs 42, if used, are formed on empty real estate at the rear surface 46 of two or more sliders 36 in the row 37.

Figure 10:
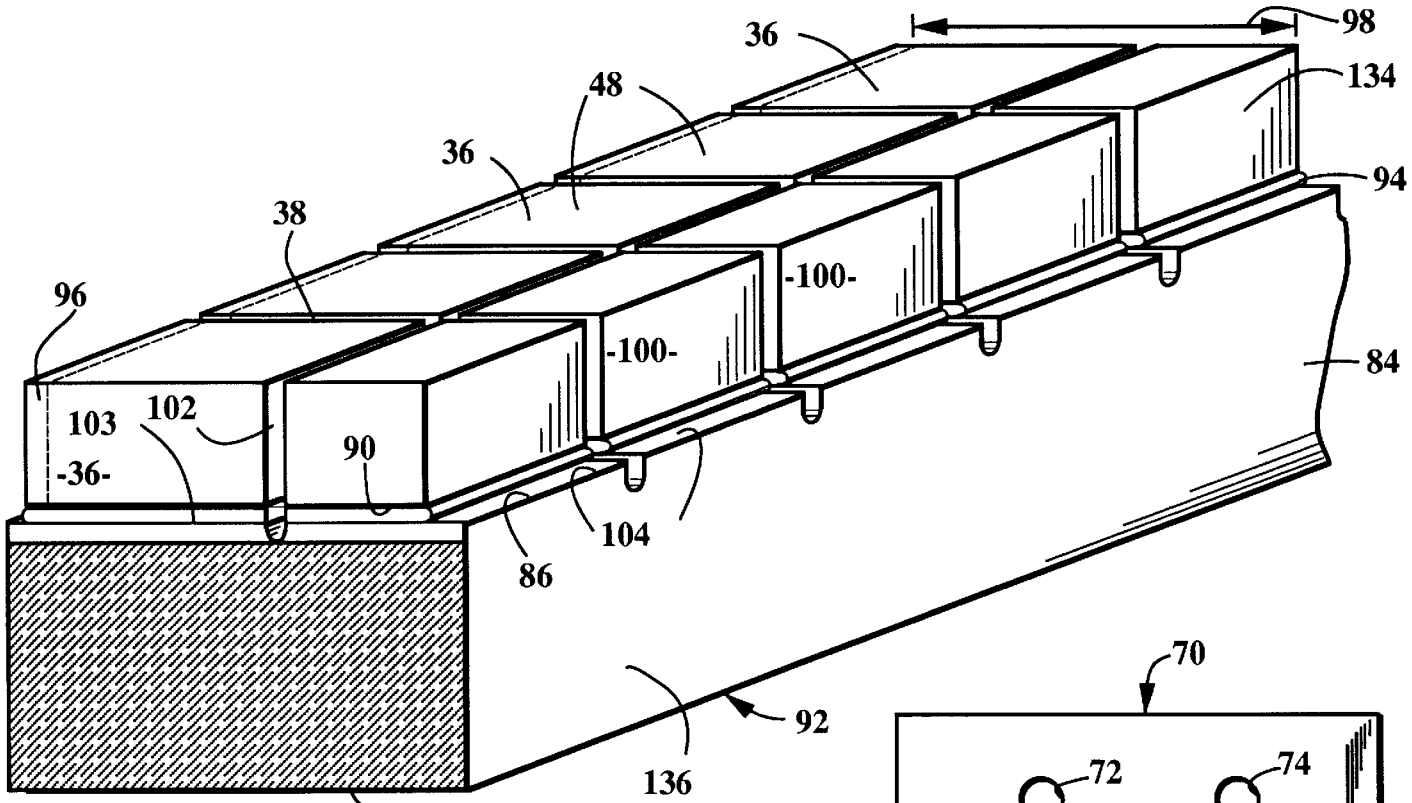
FIG. 10 is a partial cross-sectional of a perspective view of FIG. 9.
Figure 11:
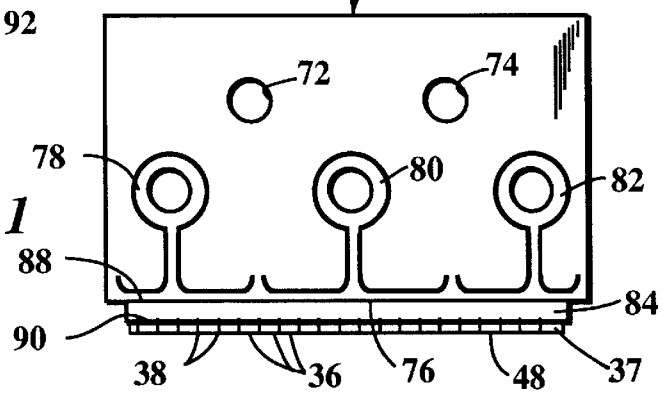
FIG. 11 is a side elevation view of the sliders and row carrier attached to a row bending tool.

FIG. 10 is a partial cross-sectional view of the assembly 92 of FIG. 9 showing the material 96 added to the wafer 30 to form the electrically operative portions of the sliders 36 and the original width of the wafer 30 (arrow 98). Since sliders 36 sized below 30% have very little surface 48 to lap, the surface 48 may become unstable during lapping. Also the very thin wafers 30 needed to make below 30% sliders 36 are difficult to process. Therefore, the sliders 36 of the present invention are usually constructed from wafers 30 thicker than they need to be to provide sufficient length to the sliders 36. As can be seen, the extra thickness or waste 100 is sliced apart from the sliders 36 by the parting area 102, but may be retained on the row carrier 84 to help stabilize the row of sliders 36 during the lapping process. Usually process steps are saved if the waste 100 is diced at the same time that the kerf areas 38 are removed. Since the kerf areas 38 are removed before the lapping process, the ELGs 42 are formed adjacent the MR sensors 32 on the sliders 36 in the material 96, or MR elements 43 may be used with the proper stimulation and measurement techniques.

The assembly 92, with the sliders 36 and the waste blocks 100, each bonded to separate surfaces 103 and 104 of the surface 86, is then bonded to the face 76 of a row bending tool 70, and the lapping process is performed, while differences in MR element resistance are accommodated by bending the row 37 during lapping so the MR element resistance of the MR sensor of each slider 36 falls within an optimum range.

As the demands for precision continue, some processes can not make MR elements precise enough to be controllably lapped using the fourth order curve bending technology discussed above. The present invention can accommodate control of much smaller groups of sliders in the row or even control of the lapping of individual sliders as shown in FIGS. 12, 13, and 14.

FIG. 12 is a partial cross-sectional view of a modified assembly 92' with the extra thickness or waste 100 at least partly ground away after it is sliced apart from the sliders 36 by the parting area 102. This allows material 120 to be removed from the slider 36 quickly during the lapping process so that the slider can be formed with a slightly curved slider surface 40. If the waste 100 is not removed, then longer lapping time can be expected. In the assembly 96', the row carrier 84' preferably is constructed from steel or other material that is not brittle like ceramic. As shown in FIG. 12, the removal of material extends almost completely through the row carrier 84', which also may be thinner than row carrier 86. This relieves the residual stresses and allows the sliders 36 in the assembly 92' to be moved individually, since the remaining areas of the row carrier 84' act like flexures. The slots 122 can also be formed in advance wider than the spacing between the diced sliders 36, although then some longitudinal alignment is required to align the slots 122 with the kerf areas 38.

The assembly 92' is then bonded to the fingers 124 of a lapping pressure applying fixture 126. Generally each of the fingers 124 are attached to a voice coil which levers them to apply more or less pressure when the row 37 is being lapped. This method requires a control device (either an ELG or the MR element itself) on each slider or small group of sliders when two or more sliders are attached to each finger 124, to be sensed during the lapping process. The lapping process is performed, while differences in MR element resistance are accommodated by bending the row carrier 84' during lapping so the MR element resistance of the MR sensor 32 of each slider 36 falls within an optimum range. The displacement between fingers 122 is just a Lew millionths of an inch, so the flexures 126 need not accommodate much travel. As shown in FIG. 15, each finger 126 may force more than one slider 36 into the proper lapping position or remove lapping force while an adjacent pair of sliders 36 are still being lapped on the lapping plate 128, only portions of which are shown.

FIG. 16 illustrates a possible alignment method for the row 37 on the row carrier 92' to assure parallel alignment there between when they are bonded together, the surface 134 that was the under surface of the wafer and the back surface of the row carrier being held against the flat surface 138 of a hard stop 140.

Thus there have been shown and described novel processes and apparatus that fulfill all the objects and advantages sought therefor. Many changes, modifications, variations, uses and applications of the subject invention will however become apparent to those skilled in the art after considering the specification and the accompanying drawings. All such changes, modifications, alterations and other uses and applications which do not depart from the spirit and scope of the invention are deemed to be covered by the invention, which is limited only by the claims that follow.

What is claimed is:

1. A process in the manufacture of disk drive sliders with read and write devices from a wafer on which a plurality of magneto-resistive read sensor blanks and write device blanks have been formed on a first surface of the wafer in rows, the first surface to become the back surfaces of the sliders formed therefrom, including:

cutting the wafer perpendicular to the first surface into rows, each row containing a plurality of slider blanks with at least one write and read sensor blank on each slider blank so each row has generally parallel second and third surfaces generally perpendicular to the first surface, with the write and read blanks facing the second surface;

mounting the third surface of a row to a first flat surface of a row carrier tool having an opposite second surface generally parallel to the first flat surface for mounting to a row bending tool;

dicing each row into separate slider blanks to relieve residual stresses therein; and lapping the second surfaces of the slider blanks to trim the magneto-resistive elements of the read sensors and to form the slider surfaces that fly over the disk of the disk drive.

2. The process as defined in claim 1 wherein said mounting of the third surface of the row to the first flat surface of the row carrier includes:

releasably bonding the third surface of the row to the first flat surface of the row carrier.

3. The process as defined in claim 1 wherein after said mounting of the third surface of a row to a first flat surface of a row carrier, further including:

cutting the slider blanks generally parallel to the first slider surface to reduce the size of the second and third surfaces and create waste blocks.

4. The process as defined in claim 3 further including:

removing at least portions of the waste blocks from the row carrier tool prior to said lapping of the second surfaces of the slider blanks to trim the magneto-resistive elements of the read sensors.

5. The process as defined in claim 3 wherein said dicing each row into separate slider blanks to relieve residual stresses therein includes:

cutting into the row carrier.

6. The process as defined in claim 5 wherein an electrical lapping guide was formed on the first surface of each slider blank of the wafer when the magneto-resistive sensors were formed, wherein said dicing of each row carrier into slider blanks includes:

dicing the row carriers without cutting into the electrical lapping guides, the write device blanks, or the magneto-resistive read sensor blanks.

7. The process as defined in claim 5 wherein said cutting into the row carrier includes:

cutting almost completely through the row carrier to form a flexure between adjacent sliders.

8. The process as defined in claim 7 wherein a plurality of flexures are formed by said cutting almost completely through the row carrier to form a flexure between adjacent sliders and said lapping of the second surfaces of the slider blanks to trim magneto-resistive read sensor blanks include:

mounting the second surface of the row carrier between flexures to individual fingers of a row bending fixture; and bending the row carrier at the flexures so that said lapping can form precise magneto-resistive read sensors when the magneto-resistive read sensor blanks are not consistently formed.

9. The process as defined in claim 7 wherein the row carrier is constructed from steel.

10. The process as defined in claim 1 wherein an electrical lapping guide was formed on the first surface of at least some of the slider blanks of the wafer when the magneto-resistive sensors were formed, wherein said dicing of each row carrier into slider blanks includes:

dicing the row carriers without cutting into the electrical lapping guides, the write device blanks, or the magneto-resistive read sensor blanks.

11. The process as defined in claim 10 wherein after said mounting of the third surface of a row to a first flat surface of a row carrier, further including:

cutting the slider blanks generally parallel to the first slider surface to reduce the size of the second and third surfaces and create waste blocks.

12. The process as defined in claim 11 further including:

removing at least portions of the waste blocks from the row carrier tool prior to said lapping of the second surfaces of the slider blanks to trim the magneto-resistive elements of the read sensors.

13. The process as defined in claim 1 wherein said lapping of the second surfaces of the slider blanks to trim magneto-resistive read sensor blanks include:

mounting the second surface of the row carrier to a row bending tool; and bending the row carrier in up to a fourth order curve so that said lapping can form precise magneto-resistive read sensors when the magneto-resistive read sensor blanks are not consistently formed.

14. The process as defined in claim 1 wherein said lapping of the second surfaces of the slider blanks to trim magneto-resistive read sensor blanks include:

mounting the second surface of the row carrier to individual fingers of a row bending fixture with at least one slider blank positioned in alignment with each finger; and bending the row carrier by applying lapping pressure through the fingers so that said lapping can form precise magneto-resistive read sensors when the magneto-resistive read sensor blanks are not consistently formed.

15. The process as defined in claim 1 wherein after said lapping the second surfaces of the slider blanks to trim the magneto-resistive elements of the read sensors, further including:

cutting the slider blanks generally parallel to the first slider surface to reduce the size of the second and third surfaces.

16. A process in the manufacture of disk drive sliders with read and write devices from a wafer on which a plurality of magneto-resistive read sensor blanks and a plurality of write device blanks have been formed on a first surface of the wafer in rows, the first surface to become the back surfaces of the sliders formed therefrom, including:

cutting the wafer perpendicular to the first surface into rows, each row containing a plurality of slider blanks with at least one write and read sensor blank on each slider blank, the cutting being so each row has generally parallel second and third surfaces generally perpendicular to the first surface, with the write and read blanks facing the second surface;

mounting the third surface of a row to a first flat surface of a row carrier tool having an opposite second surface generally parallel to the first flat surface for mounting to a row bending tool;

lapping the second surfaces of the slider blanks to trim the magneto-resistive elements of the read sensors and to form the slider surfaces that fly over the disk of the disk drive, and at some time during the fabrication of the sliders, dicing each row into separate slider blanks to relieve residual stresses therein.

17. The process as defined in claim 16 wherein said mounting of the third surface of the row to the first flat surface of the row carrier includes:

releasably bonding the third surface of the row to the first flat surface of the row carrier.

18. The process as defined in claim 16 wherein the row carrier is constructed from heat conducting material.

* * * * *